US007775961B2

(12) United States Patent
Meikrantz

(10) Patent No.: US 7,775,961 B2
(45) Date of Patent: Aug. 17, 2010

(54) MICROWAVE ASSISTED CENTRIFUGE AND RELATED METHODS

(75) Inventor: David H. Meikrantz, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 1041 days.

(21) Appl. No.: 11/349,484

(22) Filed: Feb. 6, 2006

(65) Prior Publication Data

US 2007/0184962 A1 Aug. 9, 2007

(51) Int. Cl.
*B04B 15/02* (2006.01)
*B04B 5/02* (2006.01)

(52) U.S. Cl. ..... 494/37; 494/13; 494/16; 494/20

(58) Field of Classification Search ..... 494/13, 494/16–21, 37; 210/360.1–380.3
See application file for complete search history.

(56) References Cited

U.S. PATENT DOCUMENTS 3,860,166 A * 1/1975 Anderson ..... 494/13
4,013,558 A 3/1977 Rosenberg
4,067,683 A 1/1978 Klaila
4,226,669 A * 10/1980 Vilardi ..... 159/6.1
4,412,865 A * 11/1983 Schmidt ..... 127/19
4,582,629 A 4/1986 Wolf
4,810,375 A 3/1989 Hudgins et al.
4,853,119 A 8/1989 Wolf et al.
4,853,507 A 8/1989 Samardzija
4,959,158 A 9/1990 Meikrantz
5,055,180 A 10/1991 Klaila
5,211,808 A * 5/1993 Vilardi et al. ..... 159/6.1
5,222,543 A 6/1993 Carlstrom et al.
5,254,075 A 10/1993 Nemoto et al.
5,254,076 A 10/1993 Chow et al.
5,344,493 A 9/1994 Jackson
5,368,171 A * 11/1994 Jackson ..... 134/147
5,571,070 A 11/1996 Meikrantz et al.
5,591,340 A 1/1997 Meikrantz et al.
5,762,800 A 6/1998 Meikrantz et al.
5,858,178 A * 1/1999 Lautenschlager ..... 203/73
5,908,376 A 6/1999 Macaluso et al.
5,911,885 A 6/1999 Owens
5,914,014 A 6/1999 Kartchner
6,077,400 A 6/2000 Kartchner (Continued)

FOREIGN PATENT DOCUMENTS

WO 01/26815 A1 * 4/2001

(Continued)

OTHER PUBLICATIONS

Chan, C., Chen, Y., "Demulsification of W/O Emulsions by Microwave Radiation," Separ. Sci. Tech., vol. 37, No. 15, pp. 3407-3420, 2002.

(Continued)

*Primary Examiner*—Charles E Cooley
(74) *Attorney, Agent, or Firm*—TraskBritt

(57) ABSTRACT

Centrifuge samples may be exposed to microwave energy to heat the samples during centrifugation and to promote separation of the different components or constituents of the samples using a centrifuge device configured for generating microwave energy and directing the microwave energy at a sample located in the centrifuge.

13 Claims, 5 Drawing Sheets

U.S. PATENT DOCUMENTS

| | | | | |
|---|---|---|---|---|
| 6,086,830 | A | 7/2000 | Kartchner | |
| 6,363,611 | B1 | 4/2002 | Sheldon et al. | |
| 6,723,999 | B2 | 4/2004 | Holl | |
| 6,783,993 | B1 * | 8/2004 | Malmquist | 436/177 |
| 6,820,503 | B2 * | 11/2004 | Sueyoshi et al. | 73/862.08 |
| 7,150,836 | B2 * | 12/2006 | Meikrantz | 210/748 |
| 7,498,175 | B2 * | 3/2009 | Cole | 436/177 |
| 2005/0204612 | A1 | 9/2005 | Connemann et al. | |
| 2005/0233324 | A1 * | 10/2005 | Corbett et al. | 435/6 |
| 2005/0274065 | A1 | 12/2005 | Portnoff et al. | |
| 2006/0011563 | A1 | 1/2006 | Meikrantz | |
| 2006/0162245 | A1 | 7/2006 | Porter et al. | |
| 2006/0228088 | A1 | 10/2006 | Charlier De Chily et al. | |
| 2006/0252950 | A1 | 11/2006 | Ginosar et al. | |
| 2007/0012621 | A1 | 1/2007 | Ginosar et al. | |
| 2007/0184962 | A1 * | 8/2007 | Meikrantz | 494/13 |
| 2008/0256845 | A1 * | 10/2008 | Meikrantz | |

FOREIGN PATENT DOCUMENTS

| | | |
|---|---|---|
| WO | 03014272 | 2/2003 |
| WO | WO 03093407 A1 * | 11/2003 |

OTHER PUBLICATIONS

Fang, C.S., P. Lai, B. Chang, W.J. Klaila, "Oil Recovery and Waste Reduction by Microwave Radiation," Environmental Progress, vol. 8, No. 4, pp. 235-238, Nov. 1989.

Purta, D.A., "Application of Microwaves to the Separation of Oil-Water Sludges," EPRI CMP Report No. 92-6, Jul. 1992.

Staff, "Radiowave-Based Process Recovers Oil from Sludge at Texas Site," Oil and Gas Journal, Dec. 2, 1996.

Xia, Lixin, Shiwei Lu, and Guoying Cao, "Demulsification of Emulsions Exploited by Enhanced Oil Recovery System," Sep. Sci. Technol., 38, No. 16, 4079-4094, 2003.

International Preliminary Report on Patentability/Written Opinion of the International Searching Authority, PCT/US2007/061303, International Filing Date Jan. 30, 2007, dated Aug. 12, 2008.

Leadbeater, et al. "Fast, Easy Preparation of Biodiesel Using Microwave Heating," Energy & Fuels Jul. 6, 2006, 20, 2281-2283.

* cited by examiner

MICROWAVE ASSISTED CENTRIFUGE AND RELATED METHODS

GOVERNMENT RIGHTS

This invention was made with government support under Contract Number DE-AC07-05-ID14517, awarded by the United States Department of Energy. The government has certain rights in the invention.

CROSS-REFERENCE TO RELATED APPLICATIONS

The present application is related to U.S. Pat. No. 7,150,836 entitled "MICROWAVE-EMITTING ROTOR, SEPARATOR APPARATUS INCLUDING SAME, METHODS OF OPERATION AND DESIGN THEREOF," issued Dec. 19, 2006 and to U.S. patent application Ser. No. 11/737,809 entitled "MICROWAVE-ENHANCED BIODIESEL METHOD AND APPARATUS," filed Apr. 20, 2007, pending, each of which is assigned to the Assignee of the present application.

BACKGROUND OF THE INVENTION

1. Field of the Invention

The invention relates to analytical sampling devices and, in particular, to centrifuge devices having one or more microwave energy sources for applying microwave energy to samples in the centrifuge devices.

2. State of the Art

Centrifuges are well known and are commonly used to assist with and perform analytical measurements in many different industries. Typically, centrifuges are used for separating mixtures including mixtures having constituents with different densities. Such devices provide methods for separating mixtures comprising at least two or more insoluble liquids or constituents from one another. For example, emulsions, which are a mixture of two or more immiscible liquids, may be separated using a centrifuge.

In the oil and gas industries, continuous feed centrifuges may be used to separate emulsions of oil and water or emulsions including oil, water, and solids. For example, U.S. Pat. No. 7,150,836, issued Dec. 19, 2006, entitled "MICROWAVE-EMITTING ROTOR, SEPARATOR APPARATUS INCLUDING SAME, METHODS OF OPERATION AND DESIGN THEREOF" is incorporated in its entirety herein by reference and describes various centrifuges and methods of using centrifuges to separate oil and water emulsions before and during crude oil refining processes.

Oil refining processes typically require that the amounts of water, solids, and other impurities accompanying crude oil delivered to a refining process are at or below a standard amount, for example, at about one percent. If water, solids, or other impurities in the crude oil exceed the processing limitations, damage to the refining equipment or the pipeline equipment that delivers the crude to the refinery may occur. For instance, excess amounts of water and solids in crude oil being piped to a refinery may accelerate corrosion of the pipeline. Such damage is unwanted.

In an attempt to determine the amount of impurities and undesired constituents in crude oil prior to refinement or prior to feed to a continuous centrifuge, the crude oil may be tested at the well-head or platform where the crude oil is drawn from the well. Such testing is routinely carried out and is often performed using a SETA Oil Test Centrifuge. SETA Oil Test Centrifuges are the only testing equipment currently certified to meet or exceed the ASTM (American Society of Testing and Materials) and API (American Petroleum Institute) requirements for crude oil testing.

SETA Oil Test Centrifuges generally include a swinging bucket rotor having four sample placement buckets encased in a thermally heated chamber having a closable lid. The thermally heated chamber and rotor are contained within a shell that also encloses a drive mechanism, microprocessor unit, and controls for setting, monitoring, and controlling sample runs using the SETA Oil Test Centrifuge.

Operation of the SETA Oil Test Centrifuge can be expensive. In addition, thermal heating of the samples takes time. The amount of time required to thermally heat samples being tested in a SETA Oil Test Centrifuge limits the number of samples that may be obtained and analyzed in any given period of time. In many instances, the samples being tested in a SETA Oil Test Centrifuge must also be diluted with solvents to lighten the samples and to speed up or facilitate the sampling process. The addition of solvents to the samples adds to the cost of the sampling, increases the amount of waste produced by the sampling, and can increase the safety hazards associated with the testing due to the transport and heating of solvents.

Therefore, it would be desirable to provide centrifuge testing devices and methods having improved heating capabilities. It would also be desirable to provide centrifuge testing devices that could be used to facilitate improved testing of crude oil and especially the testing of crude oil at well heads and on oil platforms and, in at least some instances, testing of oil samples without solvents.

SUMMARY OF THE INVENTION

Embodiments of the invention relate to analytical sampling devices and in particular to centrifuge devices having one or more microwave energy sources for applying microwave energy to samples in the centrifuge devices.

According to particular embodiments of the invention, a sample in a centrifuge, such as an analytical sample in a sample container, may be heated by exposure of the sample to microwave energy. The sample may be heated by microwave energy before, during or before and during centrifugation of the sample in the centrifuge.

According to other embodiments of the invention, an oil sample from a well head or an oil platform may be centrifuged in the presence of microwave energy to facilitate the centrifuging of the sample and the separating of the constituents of the oil sample. Such sampling and centrifuging may provide sample data necessary to determine the amount of centrifuging required by a continuous oil centrifuge device prior to the piping of the oil to a refinery.

In still other embodiments of the invention, a centrifuge device is provided. Centrifuge devices according to embodiments of the invention include a microwave generation device or a source of microwave energy. Microwave energy provided to the centrifuge device or generated by the microwave generation device may be directed into a centrifuge chamber holding samples for centrifugation. The presence of microwave energy in the centrifuge chamber may heat samples contained therein. The microwave energy may be provided to the centrifuge chamber before or during the centrifugation of samples contained in the chamber.

In still other embodiments of the invention, a portable analytical centrifuge device is provided. The portable analytical centrifuge device may be used to test oil samples containing oil, water, and other impurities from well heads and oil platforms. The portable analytical centrifuge may include a microwave generation device that may be used to expose the samples being centrifuged to microwave energy.

BRIEF DESCRIPTION OF THE DRAWINGS

While the specification concludes with claims particularly pointing out and distinctly claiming that which is regarded as the present invention, this invention can be more readily understood and appreciated by one of ordinary skill in the art from the following description of the invention when read in conjunction with the accompanying drawings in which:

DETAILED DESCRIPTION

The invention relates to analytical devices and, in particular, to analytical devices incorporating both centrifugal action and microwave energy to separate mixtures comprising two or more constituents or insoluble constituents.

According to particular embodiments of the invention, a centrifuge may be equipped with a microwave generation device to provide microwave energy to a chamber within the centrifuge wherein the chamber holds samples for centrifuging. The microwave generation device may be used in conjunction with the centrifuge to apply microwave energy to samples being centrifuged by the centrifuge device. In at least some embodiments, the centrifuge may be a batch centrifuge or a centrifuge capable of centrifuging discrete or individual samples.

Figure 1:
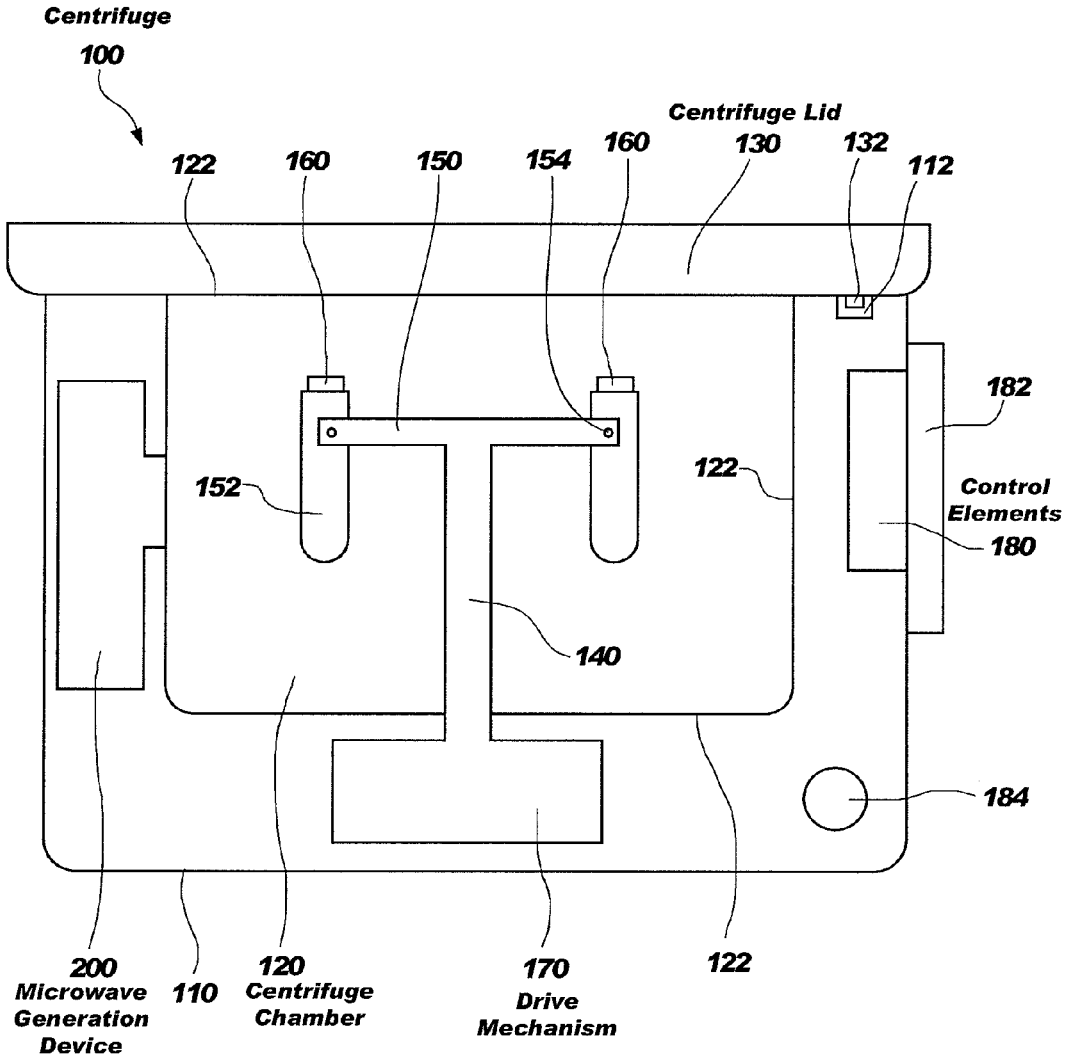
FIG. 1 illustrates a schematic cross-sectional view of a centrifuge device according to particular embodiments of the invention.

A centrifuge device 100 according to particular embodiments of the invention is illustrated in FIG. 1. The centrifuge device 100 includes a centrifuge housing 110 and a centrifuge chamber 120 defined within at least a portion of the centrifuge housing 110. A centrifuge lid 130 may be configured to allow access to the centrifuge chamber 120 and to isolate the centrifuge chamber 120 when the centrifuge lid 130 is in a closed position over the centrifuge housing 110. The centrifuge device 100 may also include centrifuge components for centrifuging samples. For example, the centrifuge device illustrated in FIG. 1 includes a drive shaft 140 extending into at least a portion of the centrifuge chamber 120. A centrifuge arm 150 supporting one or more sample containers 160, such as diametrically opposed sample containers 160, may be connected to the drive shaft 140. The drive shaft 140 may be connected to a drive mechanism 170 to rotate the drive shaft 140. Control elements 180 for controlling the operations of the centrifuge device 100 may be enclosed within the centrifuge housing 110 as illustrated in FIG. 1 or outside of the centrifuge housing (not shown). A microwave generation device 200 may also be contained within the centrifuge housing 110 and may be configured to provide microwave energy to the centrifuge chamber 120. A power source 184, such as an electrical power source, may provide power to the centrifuge device 100 to facilitate operation of the drive mechanism 170, the microwave generation device 200, the control elements 180, or any additional components adapted for use with embodiments of the invention.

Figure 2:
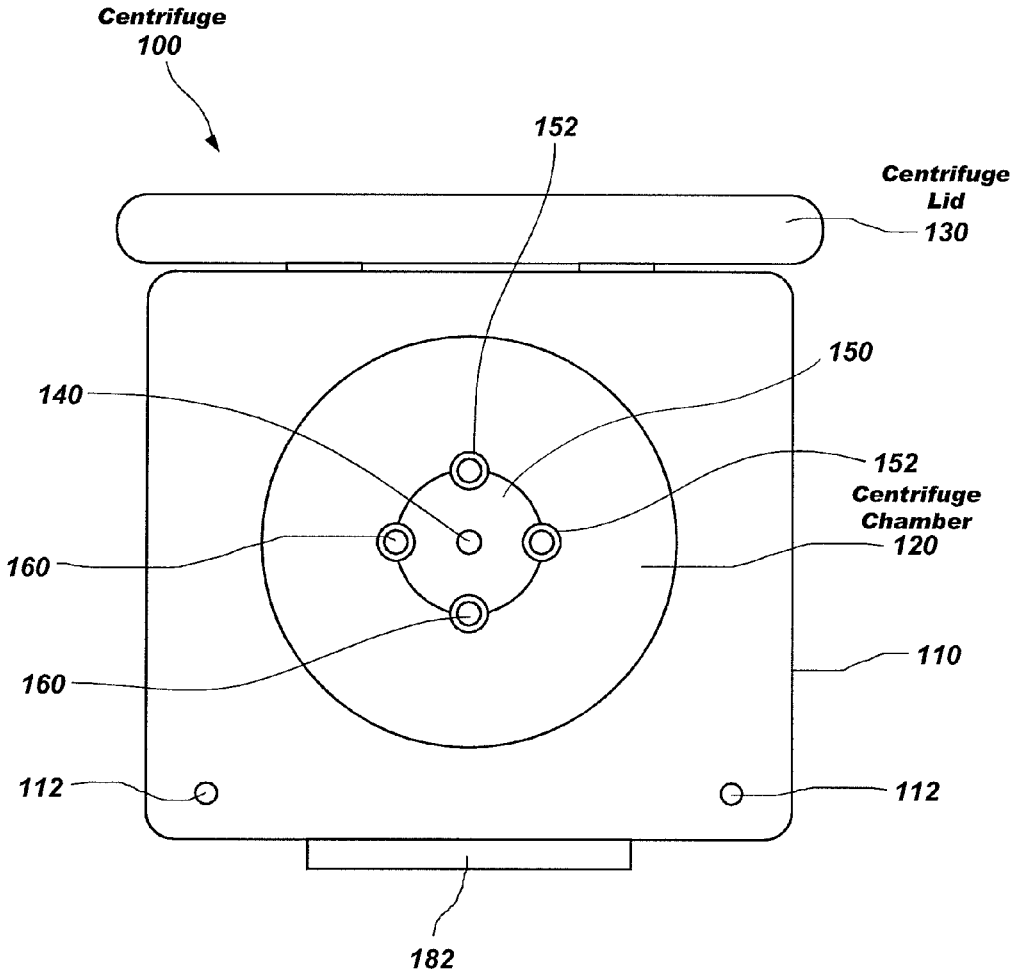
FIG. 2 illustrates a top-down view of a centrifuge device according to particular embodiments of the invention.

An alternative view of the centrifuge device 100 illustrated in FIG. 1 is illustrated in FIG. 2, which shows a top-down view of a centrifuge device 100 having the centrifuge lid 130 open according to embodiments of the invention, and four sample containers 160.

The centrifuge housing 110 may serve as an enclosure for enclosing the various components of the invention and may be formed from any suitable material. In some embodiments, the centrifuge housing 110 may be constructed of a material that is resilient to the environment, which is generally somewhat hostile in terms of heat and corrosive atmosphere, in which the centrifuge device 100 is to be used. As another example, a centrifuge device 100 used with caustic chemical applications may be constructed of a material that is resilient to the caustic environment to which it may be subjected. Materials such as suitably environmentally resistant metals and alloys, carbon fiber, ceramics, and plastics, among others, may be used individually or in combination.

Referring to FIGS. 1 and 2, the centrifuge chamber 120 according to embodiments of the invention may comprise an enclosable chamber within which samples may be centrifuged and wherein microwave energy may be applied to samples enclosed therewithin. The walls of the centrifuge chamber 120 and of centrifuge lid 130 may be formed of a microwave reflective surface 122 such that microwave energy supplied to the centrifuge chamber 120 is reflected within the centrifuge chamber 120, thereby containing the microwave energy within centrifuge chamber 120 while exposing the contents of the centrifuge chamber 120 to the microwave energy supplied thereto. Alternatively, the centrifuge chamber 120 and centrifuge lid 130 may be lined with a microwave reflective surface 122 or a microwave reflective surface 122 may be incorporated around the centrifuge chamber 120 and centrifuge lid 130 to maintain microwave energy introduced to the centrifuge chamber 120 within the centrifuge chamber 120.

Microwave reflective surfaces 122 used with embodiments of the invention may include surfaces such as metal surfaces, ceramic surfaces, and other conducting surfaces. The microwave reflective surfaces 122 may also include perforated conductive surfaces wherein the perforations are small enough that microwaves may not pass through the perforations. For example, the microwave reflective surfaces 122 incorporated with embodiments of the invention may include surfaces that are used with conventional microwave oven technology. This may include conductive metal surfaces or conductive metal perforated mesh surfaces capable of reflecting microwaves.

The centrifuge lid 130 may be configured such that it may be opened to permit access to the centrifuge chamber 120. The centrifuge lid 130 may also be closed to establish isolation of the centrifuge chamber 120. According to embodiments of the invention and as noted above, the centrifuge lid 130 exposed to the centrifuge chamber 120, or those portions of the centrifuge lid 130 that may be exposed to microwave energy, are constructed of, coated with, or lined with a microwave reflective surface 122. Therefore, when the centrifuge lid 130 is in a closed position, microwaves introduced into the centrifuge chamber 120 may be reflected off of the microwave reflective surface 122 of the centrifuge lid 130 back into the centrifuge chamber 120.

According to some embodiments of the invention, the centrifuge lid 130 may include one or more latches 132 that may fit into one or more latch openings 112 in the centrifuge housing 110. The latches 132 may provide a securing or locking mechanism to maintain the centrifuge lid 130 in a closed position until the latch 132 is released by a latch release mechanism (not shown) such as by a manual latch release mechanism or a release mechanism controlled by the control elements 180 of the centrifuge device 100. The latches 132 may also act as a safety switch such that when a latch 132 is properly engaged with a latch opening 112 microwaves may be emitted into the centrifuge chamber 120 by the microwave generation device 200; however, when a latch 132 is not properly engaged with a latch opening 112, the microwave generation device 200 may be disengaged so that microwaves cannot be emitted into the centrifuge chamber 120.

The drive shaft 140 is positioned within the centrifuge chamber 120 and extends through the wall of centrifuge chamber 120 where it connects to a drive mechanism 170. As illustrated in FIG. 1, the drive shaft 140 may extend through a bottom portion of the centrifuge chamber 120 to connect to drive mechanism 170. According to particular embodiments, the drive shaft 140 may be positioned within the center of the centrifuge chamber 120 with respect to the walls of the centrifuge chamber 120; however, such positioning is not required. Although the drive shaft 140 illustrated in FIG. 1 is depicted as a unitary drive shaft 140, it is understood that various configurations of the drive shaft 140, such as a multipiece drive shaft (not shown), may be adopted and used with embodiments of the invention. In some embodiments, for example, the drive shaft 140 may extend from a connection with a drive mechanism 170 into the centrifuge chamber 120 and be surrounded by a drive shaft sleeve 142 (FIG. 4) that is an integral part of the centrifuge chamber 120. In many embodiments, the drive shaft 140 may be similar to or identical to drive shafts used with conventional centrifuge devices.

According to some embodiments of the invention, the drive shaft 140 may be constructed from, coated with, or lined with a microwave reflecting material. In other embodiments, a drive shaft sleeve 142 (FIG. 4) incorporated as a part of the centrifuge chamber 120 and encompassing the drive shaft 140 may be constructed from, coated with, or lined with a microwave reflecting material.

The drive shaft 140 of embodiments of the invention may be used to rotate various types of centrifuge devices. For example, a centrifuge arm 150 connected to the drive shaft 140 is illustrated in FIG. 1. The centrifuge arm 150 may accommodate one or more, and preferably two or more, swinging bucket sample holders 152 configured to receive sample containers 160. Although the centrifuge arm 150 illustrated in FIG. 2 is shown holding four sample containers 160 in swinging bucket sample holders 152, it is understood that the centrifuge arm 150 or other sample support device may be configured to hold additional sample containers 160. It is also understood that other swinging bucket type sample holders may be used with embodiments of the invention. The swinging bucket sample holder 152 may be configured to support a sample container 160 in a substantially vertical position when the drive shaft 140 is not in motion. As the drive shaft 140 rotates, the swinging bucket sample holder 152, which, as shown, is pivotally mounted at 154 about a horizontal axis, is allowed to rotate in response to centripetal forces exerted upon a sample container 160 being supported by the swinging bucket sample holder 152. As the centripetal forces caused by the rotation of the drive shaft 140 increase, the sample containers 160 held in position by the pivotally mounted swinging bucket sample holders 152 may swing outwards toward the walls of the centrifuge chamber 120 such that the bottom portions of the sample containers 160 are directed toward the walls of the centrifuge chamber 120.

Figure 3:
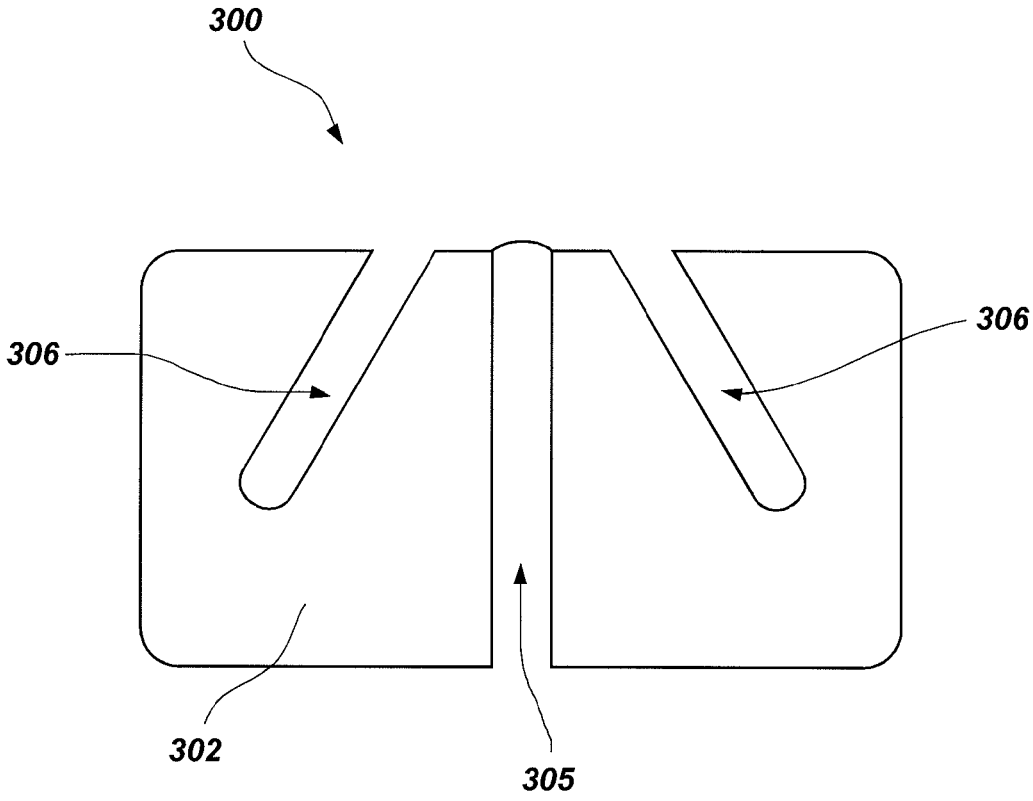
FIG. 3 illustrates a cross-sectional view of a rotor device that may be used with centrifuge devices according to particular embodiments of the invention.

According to other embodiments of the invention, alternatively configured sample holders may be used with a centrifuge device 100. For example, a fixed angle rotor device 300, as illustrated in FIG. 3, may be configured to attach to the drive shaft 140 of a centrifuge device 100. The fixed angle rotor device 300 may include a rotor body 302 having one or more, and preferably two or more, sample container inserts 306 positioned within the rotor body 302. The sample container inserts 306 may be configured to hold sample containers (not shown) similar to or identical to those illustrated in FIG. 1. A central rotor shaft 305 in the rotor body 302 may be configured to fit over and connect to a drive shaft 140 of a centrifuge device 100, such as that illustrated in FIG. 1. For example, the centrifuge arm 150 and swinging bucket sample holder 152, illustrated in FIG. 1, may be disconnected from the drive shaft 140 and the central rotor shaft 305 of the fixed angle rotor device 300, illustrated in FIG. 3, may be positioned on and removably connected to the drive shaft 140 such that rotation of the drive shaft 140 causes rotation of the fixed angle rotor device 300.

Sample holders, centrifuge arms 150, fixed angle rotor devices 300 and other components configured for use with embodiments of the invention may be made of different materials and may be partially or fully constructed of or coated with a microwave reflecting material. Alternatively, the materials used to form components used to centrifuge samples may be constructed of microwave energy transparent materials.

Sample containers 160 may include many different types of sample containers 160 and particularly those designed and manufactured for use with centrifuge devices 100. For example, sample containers 160 may include containers constructed of glass, metal, plastics, ceramic, or other materials. In those embodiments of the invention where microwave energy is directed into the centrifuge chamber 120, the sample containers 160 may be at least partially constructed of a material that is substantially transparent to such microwave energy. For example, sample containers 160 may be constructed in part of a plastic, a polymer, a water-free ceramic, a quartz material, or a glass. In many embodiments, glass sample containers 160 such as borosilicate glass centrifuge tubes may be used. The sample containers 160 may also have different shapes, sizes, and volumetric capacities. For instance, when testing oil samples at a well head or oil platform head, 6- or 8-inch conical glass centrifuge tubes, 8-inch trace sediment glass centrifuge tubes, or 8-inch pear-shaped glass centrifuge tubes may be used as sample containers 160.

According to particular embodiments of the invention, the sample containers 160 may also include markings integrated with the sample containers 160, wherein the markings may be used to determine the amount or volume of a particular constituent in a sample. For example, a sample container 160 used to test the composition of oil at a well head, and particularly the amount of water and other impurities found in the oil, may include graduated markings along a length of the sample container 160. Following centrifuging of a sample contained in the sample container 160, the graduated markings may be used to determine the amount of the various constituents in the sample.

A drive mechanism 170 for use with embodiments of the present invention may include any type of drive mechanism 170 used with conventional centrifuge devices, such as an electric motor. The drive mechanism 170 may be connected to the drive shaft 140 and is capable of rotating the drive shaft 140 and a centrifuge arm 150, a fixed angle rotor device 300, or another sample support device holding sample containers 160 and samples for centrifuging. The drive shaft 140 may comprise a portion of the motor assembly, rather than a separate component. In particular embodiments of the invention, the drive mechanism 170 may be capable of rotating the drive shaft 140 such that samples in the centrifuge chamber 120 are rotated at between about 1000 to about 3000 revolutions per minute (rpm). In other embodiments, the drive mechanism 170 may be capable of rotating the drive shaft 140 and samples in the centrifuge chamber 120 at between about 500 to about 6000 revolutions per minute. Drive mechanisms 170 capable of achieving a smaller or greater number of revolutions per minute may also be selected and incorporated with embodiments of the invention depending upon the number of revolutions per minute required for a particular centrifuge device 100 or sample testing.

Figure 4:
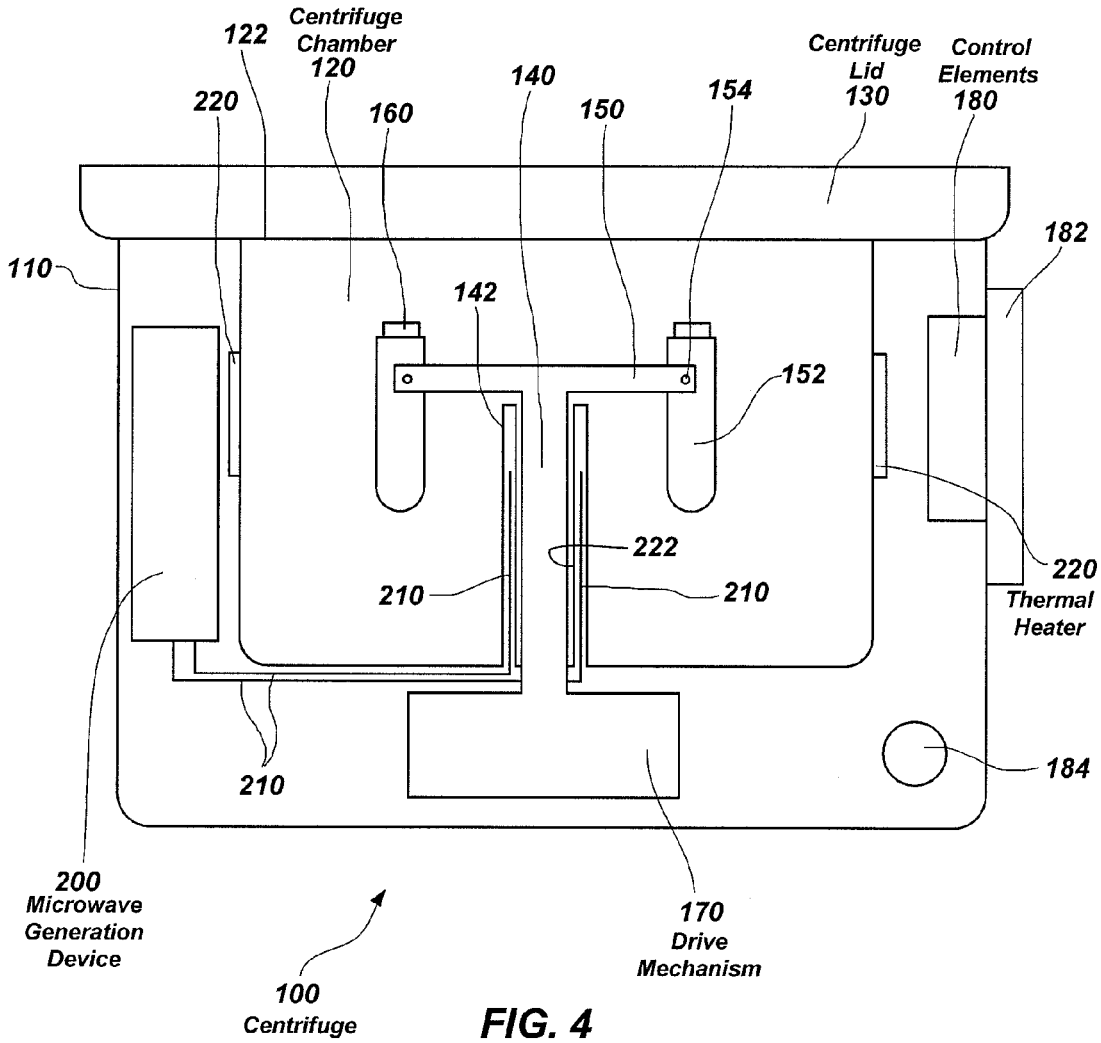
FIG. 4 illustrates a schematic cross-sectional view of a centrifuge device according to particular embodiments of the invention.

The drive mechanism 170 illustrated in FIGS. 1 and 4 is positioned outside of the centrifuge chamber 120. However, the drive mechanism 170 may be positioned inside the centrifuge chamber 120 or as part of the drive shaft 140 if the drive mechanism 170 is shielded from microwave energy or constructed such that microwave energy will not damage or hinder the function of the drive mechanism 170.

Centrifuge devices 100 according to particular embodiments of the invention may also include control elements 180 for controlling the various operations of the centrifuge devices 100 of the invention. The control elements 180 may include automatic controls such as microprocessor controls, manual controls, or other controls capable of starting and stopping the drive mechanism 170, drive shaft 140, microwave generation device 200, or other devices incorporated with the centrifuge device 100. For example, a control panel 182 may be fitted into the centrifuge housing 110 and connected to the control elements 180, such as a microprocessor control unit. The control panel 182 may be connected to a microprocessor control element capable of providing various readouts for monitoring the operations of the centrifuge device 100 such as the revolutions per minute of samples being centrifuged, a time element associated with the centrifugation, the temperature of the samples or of the centrifuge chamber 120, or any other variables that can be monitored using control elements 180. The control panel 182 may also include input elements that may allow a user to set the desired variables and requirements for the centrifuging of a sample. For instance, control inputs incorporated with the control panel 182 may allow a user to set and view the desired number of revolutions per minute for centrifugation of a sample, to set and view the amount of time for the centrifugation of a sample, to trigger the use of the microwave generation device 200, to control the amount of time that microwave energy is supplied by microwave generation device 200, to control the amount and strength of microwave energy applied, to control the type of microwave energy applied, to turn the centrifuge device 100 on or off, or to perform any other functions incorporated with the control elements 180 of the centrifuge device 100.

One or more power sources 184 may be connected to the centrifuge device 100 or incorporated within the centrifuge housing 110 to provide power to the control elements 180, the drive mechanism 170, the microwave generation device 200, or other components of the centrifuge device 100. According to particular embodiments of the invention, the power source 184 may include a battery, a plurality of batteries, or a conventional power grid or generator-type electric power source.

According to particular embodiments of the invention, the centrifuge device 100 includes one or microwave generating devices 200 configured for supplying microwave energy to the centrifuge chamber 120 where samples in the centrifuge chamber 120 may be exposed to the microwave energy. As illustrated in FIG. 1, a microwave generating device 200 may be contained within the centrifuge housing 110 and in communication with the centrifuge chamber 120 such that microwave energy generated by the microwave generation device 200 is directed into the centrifuge chamber 120. In alternative embodiments, the microwave generating device 200 may be located outside the centrifuge housing 110 and may include a communication pathway (not shown) such as a waveguide for directing microwave energy into the centrifuge chamber 120 of the centrifuge device 100.

Microwave generating devices 200 according to embodiments of the invention may include any device capable of generating microwave energy and may include devices such as a maser, a klystron, or a magnetron tube. In particular embodiments of the invention, the microwave generating device 200 may include a magnetron configured to controllably supply microwave energy to the centrifuge chamber 120.

The microwave generating devices 200 incorporated with embodiments of the invention may also include microwave transmission or amplification components to direct, focus, or otherwise influence the characteristics of microwave energy generated by the microwave generation device 200. For example, one or more of a microwave waveguide, coupler, splitter, modulator, mixer, filter, amplifier, converter, attenuator, antenna, or other microwave transmission or communication device may be included in a microwave generating device 200 according to embodiments of the invention.

Microwave energy generated by the microwave generation device 200 may be introduced into the centrifuge chamber 120 through a wall, top or bottom surface of the centrifuge chamber 120. If the microwave energy is introduced through a surface of the centrifuge chamber 120, that portion of the surface through which the microwave energy is introduced may not include a microwave reflective surface 122. In some embodiments, however, those portions of the surface around the introduction location of the microwave energy may include microwave reflective surfaces 122 or perforated surfaces to prevent the escape of microwave energy outside of the centrifuge chamber 120. For instance, as illustrated in FIG. 1 the microwave generating device 200 includes a portion thereof which is in communication with a wall of the centrifuge chamber 120 for delivering microwave energy into the centrifuge chamber 120. The portion of the centrifuge chamber 120 wall wherein microwave energy is introduced may be substantially transparent to microwave energy such that microwave energy generated by the microwave generation device 200 may enter the centrifuge chamber 120. A microwave reflective surface 122 or mesh may be placed behind that portion of the centrifuge chamber 120 wall in which the microwave energy enters to help ensure that microwave energy does not escape the centrifuge chamber 120.

In other particular embodiments of the invention, the microwave energy generated by the microwave generation device 200 may be introduced into the centrifuge chamber 120 through an opening (not shown) in the centrifuge lid 130. In such instances, at least a portion of the microwave generation device 200 may be incorporated into the centrifuge lid 130 to deliver microwave energy into the centrifuge chamber 120.

In still other embodiments of the invention, the microwave generation device 200 may deliver microwave energy into the centrifuge chamber 120 through the drive shaft 140 or through a drive shaft sleeve 142, as illustrated in FIG. 4. For instance, the microwave generation device 200 may include extensions 210 which extend into a drive shaft sleeve 142 extending into the centrifuge chamber 120. A surface of the drive shaft sleeve 142 between the centrifuge chamber 120 and the extensions 210 may be substantially transparent to microwave energy such that microwave energy generated by the microwave generating device 200 may be introduced into the centrifuge chamber 120 by the extensions 210. The opposite surface of the drive shaft sleeve 142 between the extensions 210 and the drive shaft 140 may be constructed of, lined with, or coated with a microwave reflective surface 222, such that microwave energy is not introduced into the drive shaft 140. In other embodiments, the extensions 210 could be incorporated as part of the drive shaft 140 such that microwave energy may be introduced into the centrifuge chamber 120 from the drive shaft 140.

According to still other embodiments of the invention, microwave energy may be introduced into the centrifuge chamber 120 in a focused manner such that the microwave energy is focused upon the sample containers 160 and any samples contained therein.

Figure 5:
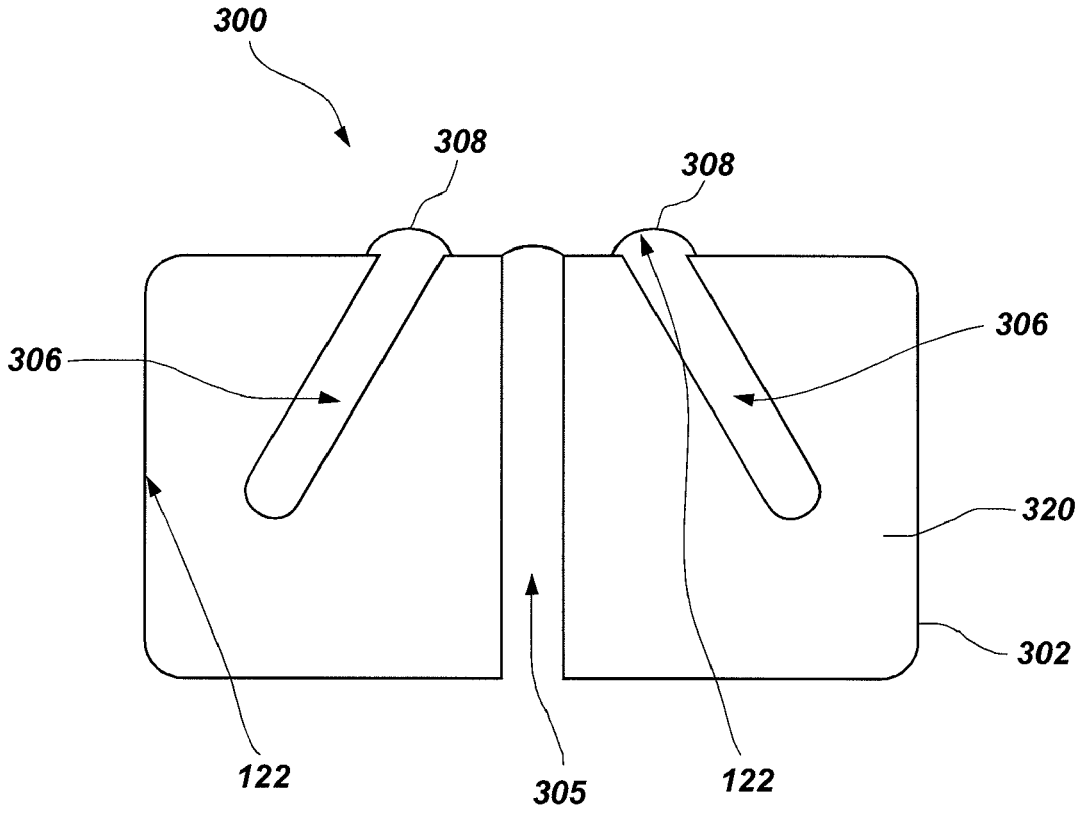
FIG. 5 illustrates a cross-sectional view of another rotor device that may be used with centrifuge devices according to particular embodiments of the invention.

In other embodiments of the invention, microwave energy may be introduced into the rotor body 302 of a fixed angle rotor device 300 such as that illustrated in FIG. 5, thereby exposing any samples contained in the sample container inserts 306 to microwave energy. For instance, the fixed angle rotor device 300 illustrated in FIG. 5 may include a hollow chamber 320 within the rotor body 302 into which the sample container inserts 306 extend. The sample container inserts 306 may be substantially transparent to microwave energy and may include caps 308 that may cover the sample container insert 306 after a sample has been inserted therein or a sample container 160 containing a sample has been inserted therein. The interior walls of the hollow chamber 320 and the caps 308 may include a microwave reflective surface 122 such that microwave energy introduced into the hollow chamber 320 will not escape from the hollow chamber 320. Microwave energy generated by a microwave generation device 200 (FIG. 1) may be introduced into the hollow chamber 320 through the central rotor shaft 305 or through a surface of the hollow chamber 320, as with other embodiments of the invention.

According to particular embodiments of the invention, a centrifuge device 100, such as that illustrated in FIGS. 1, 2, and 4, may adapted for analytically testing oil samples and in some instances, for testing oil samples from oil well heads or oil platforms prior to transportation of the oil to a refinery or feed of the oil to a continuous centrifuge. An oil sample retrieved from an oil well head may be placed in a sample container 160 and inserted into the centrifuge device 100 where it is supported by a swinging bucket sample holder 152, a sample container insert 306, or another sample holding device depending upon the type of rotor being used with the centrifuge device 100. The sample may be placed in the centrifuge device 100 according to conventional centrifuge practices, for example, if a first sample is placed in the centrifuge device 100, a second sample or mass balancing object of equal mass is also placed in the centrifuge device 100 directly opposite the first sample. The second sample helps to balance the first sample during centrifugation of the samples. With the centrifuge lid 130 closed, the centrifuge device 100 may be activated to centrifuge the samples contained therein. In addition, microwave energy introduced into the centrifuge chamber 120 by the microwave generation device 200 may heat the samples being centrifuged. The heating of the samples by the microwave energy promotes the separation of the different constituents of the samples—oil, water, and other impurities—and facilitates the centrifugation of the samples. Upon completion of the centrifugation of the samples, the samples may be withdrawn from the centrifuge device 100 and the amount of each constituent in the sample determined by analyzing the sample containers 160 according to conventional methods.

According to still other embodiments of the invention, thermal heaters 220 such as that illustrated in FIG. 4 may be attached or otherwise configured to provide thermal heat to the centrifuge chamber 120 or the samples contained within the centrifuge chamber 120. The combination of thermal heat and heat caused by application of microwave energy to samples in the centrifuge chamber 120 may be beneficial. For example, microwave energy may be used to rapidly heat the samples to a desired temperature where the thermal heaters 220 are preset in order to maintain the temperature within the centrifuge chamber 120 at a preset temperature. The use of microwave energy to rapidly heat the samples may decrease the amount of time required to run the samples because the heating of the samples is faster with microwave energy than with thermal energy.

Embodiments of the invention also include the application of microwave energy to a sample being centrifuged during the centrifugation of the sample. For instance, samples of an oil-water emulsion may be placed in a centrifuge device 100 according to embodiments of the invention. Settings for controlling the centrifugation speed and time desired for the samples may be entered into the control panel 182 (FIGS. 1 and 4). In addition, settings for controlling an amount of microwave energy applied to the samples during centrifugation and the strength and time of the microwave energy exposure may be set using the control panel 182. As the samples are centrifuged, microwave energy may be controllably applied to the samples in the centrifuge device 100 by a microwave generation device 200.

The introduction of microwave energy into a centrifuge exposes the samples therein to the microwave energy and results in rapid, localized heating of the samples. The heating of the samples aids in the separation of different constituents of the samples. For example, an oil sample drawn from a well head may be centrifuged to determine the amount of water, solids, and other impurities in the oil sample. When the oil sample is placed in the centrifuge and exposed to microwave energy, it rapidly heats up. The heating of the oil sample by the microwave energy facilitates the separation of the oil, water, and solids in the sample, thereby decreasing the amount of centrifuge time required to complete the separation of the constituents of the sample. In addition, the use of microwave energy to heat the sample reduces or eliminates the need for solvent dilution of an oil sample being separated in a centrifuge.

A sample centrifuged in the presence of microwave energy in accordance with embodiments of the invention may be analyzed by conventional methods. For example, graduated sample containers may be used such that when a centrifuged sample is removed from the centrifuge device, the amounts of each constituent in the sample may be determined by reading the graduated markings on the sample container.

Unlike centrifuge devices employing thermal heating processes (such as the SETA Oil Test Centrifuge), the microwave energy applied to samples in the centrifuge devices according to particular embodiments of the invention is capable of rapidly heating the samples. The rapid heating provided by the use of microwave energy reduces the amount of time required to completely separate the constituents of a sample being centrifuged. For example, heating oil samples by way of microwave energy rather than thermal energy reduces the amount of time to centrifuge a sample by a factor of about three. Thus, three times as many oil samples may be centrifuged and analyzed using embodiments of the present invention as compared to thermal centrifuge devices.

Embodiments of the present invention may also provide less expensive alternatives to thermal centrifuge devices. The costs associated with the parts and the building of microwave energy centrifuges according to embodiments of the invention may be much less than those associated with thermal centrifuge devices, especially since conventional microwave oven technology may be incorporated into the centrifuges according to embodiments of the present invention. The weight of the equipment used to construct microwave energy centrifuge devices according to embodiments of the invention may also be less than the weight of thermal centrifuge devices, thereby decreasing the overall weight of the centrifuge device and increasing the portability of the device. The increased portability and decreased weight is advantageous when such centrifuge devices must be transported into the field for testing, such as for testing of oil samples at well heads or on well platforms, particularly offshore platforms and those in other remote locations.

Particular embodiments of the invention also include methods for heating samples in a centrifuge. According to such embodiments, a sample placed in a centrifuge may be heated by microwave energy introduced into the centrifuge chamber or by microwave energy introduced into the samples during centrifuging.

In other embodiments, methods for decreasing the amount of time required to separate a sample into its constituents in a centrifuge are provided by the introduction of microwave energy into the centrifuge during operation to heat the samples. In some instances, the introduction of microwave energy will heat the samples and promote separation of the constituents of the samples.

Although particular embodiments of the invention have been described with respect to oil samples and oil and water emulsions, the embodiments of the invention are not limited to the testing of such samples. It is understood that particular embodiments of the invention may be configured or adapted to test different types of samples and particularly samples which may separate or may more easily separate when heated by microwave energy.

Having thus described certain currently preferred embodiments of the present invention, it is understood that the invention defined by the appended claims is not to be limited by particular details set forth in the above description, as many apparent variations thereof are contemplated without departing from the spirit or scope thereof as hereinafter claimed.

What is claimed is:

1. A method of centrifuging a sample, comprising:

disposing a sample comprising a mixture of oil and water in at least one sample container;

disposing the at least one sample container in a centrifuge apparatus within a centrifuge chamber;

rotating the centrifuge apparatus to centrifuge the sample in the at least one sample container;

communicating microwave energy from a microwave generation device into the centrifuge chamber during at least a portion of the rotation of the centrifuge apparatus to heat the sample in the at least one sample container comprising applying microwave energy to the sample in the centrifuge chamber through a sleeve at least partially surrounding a drive shaft of the centrifuge apparatus; and separating at least a portion of the oil in the sample from at least a portion of the water in the sample.

2. The method of claim 1, further comprising communicating microwave energy from the microwave generation device into the centrifuge chamber before rotating the centrifuge apparatus.

3. The method of claim 1, further comprising controlling centrifuging of the sample and the communication of the microwave energy into the centrifuge chamber with at least one microprocessor control element.

4. The method of claim 1, further comprising selecting the microwave generation device from the group consisting of a maser, a klystron, and a magnetron.

5. The method of claim 1, further comprising:

determining an amount of the oil in the sample; and determining an amount of the water in the sample.

6. The method of claim 1, wherein communicating microwave energy from a microwave generation device into the centrifuge chamber comprises:

extending at least one extension of the microwave generation device into the centrifuge chamber through the sleeve at least partially surrounding the drive shaft of the centrifuge apparatus; and applying microwave energy to the sample in the centrifuge chamber through the at least one extension.

7. The method of claim 6, further comprising disposing a microwave reflecting material on an interior surface of the sleeve between the at least one extension and the drive shaft.

8. The method of claim 1, further comprising disposing a microwave reflecting material on an interior surface of the centrifuge chamber.

9. The method of claim 1, wherein rotating the centrifuge apparatus to centrifuge the sample in the at least one sample container comprises rotating the centrifuge apparatus to centrifuge the sample in the at least one sample container with a drive mechanism connected to a drive shaft of the centrifuge apparatus.

10. The method of claim 1, wherein disposing a sample comprising a mixture of oil and water in at least one sample container comprises disposing the at least one sample container in at least one of a swinging bucket rotor device and a fixed angle rotor device.

11. The method of claim 1, further comprising:

forming a hollow chamber within the centrifuge apparatus; and disposing a microwave reflective surface on at least a portion of a surface of the hollow chamber.

12. The method of claim 1, further comprising heating the centrifuge chamber with a thermal heater.

13. A method of centrifuging a sample, comprising:

disposing a sample comprising a mixture of oil and water in at least one sample container;

disposing the at least one sample container in a centrifuge apparatus within a centrifuge chamber;

rotating the centrifuge apparatus to centrifuge the sample in the at least one sample container;

communicating microwave energy from a microwave generation device into the centrifuge chamber during at least a portion of the rotation of the centrifuge apparatus to heat the sample in the at least one sample container comprising applying microwave energy to the sample in the centrifuge chamber through a drive shaft of the centrifuge apparatus; and separating at least a portion of the oil in the sample from at least a portion of the water in the sample.

* * * * *

UNITED STATES PATENT AND TRADEMARK OFFICE

CERTIFICATE OF CORRECTION

PATENT NO. : 7,775,961 B2
APPLICATION NO. : 11/349484
DATED : August 17, 2010
INVENTOR(S) : David H. Meikrantz It is certified that error appears in the above-identified patent and that said Letters Patent is hereby corrected as shown below:

In the specification:

COLUMN 1, LINE 4, before "GOVERNMENT RIGHTS" insert
--CROSS-REFERENCE TO RELATED APPLICATIONS
The present application is related to U.S. Patent No. 7,150,836 entitled "MICROWAVE-EMITTING ROTOR, SEPARATOR APPARATUS INCLUDING SAME, METHODS OF OPERATION AND DESIGN THEREOF," issued Dec. 19, 2006 and to U.S. Patent Application Serial No. 11/737,809 entitled "MICROWAVE-ENHANCED BIODIESEL METHOD AND APPARATUS," filed Apr. 20, 2007, pending, each of which is assigned to the Assignee of the present application.--

COLUMN 1, LINES 11-23, DELETE
"CROSS-REFERENCE TO RELATED APPLICATIONS
The present application is related to U.S. Pat. No. 7,150,836 entitled "MICROWAVE-EMITTING ROTOR, SEPARATOR APPARATUS INCLUDING SAME, METHODS OF OPERATION AND DESIGN THEREOF," issued Dec. 19, 2006 and to U.S. patent application Ser. No. 11/737,809 entitled "MICROWAVE-ENHANCED BIODIESEL METHOD AND APPARATUS," filed Apr. 20, 2007, pending, each of which is assigned to the Assignee of the present application."

Signed and Sealed this
Twenty-fourth Day of September, 2013

Teresa Stanek Rea
*Deputy Director of the United States Patent and Trademark Office*